United States Patent [19]

Dumas et al.

[11] Patent Number: 4,760,792

[45] Date of Patent: Aug. 2, 1988

[54] PYROTECHNIC DELAY FOR HIGH G'S APPLICATION

[75] Inventors: Ghislain M. Dumas; Roger Lavertu, both of Ste-Foy, Canada; Jean-Francois Drolet, McLean, Va.

[73] Assignee: Her Majesty the Queen in right of Canada, as represented by the Minister of National Defence, Canada

[21] Appl. No.: 29,801

[22] Filed: Mar. 25, 1987

[30] Foreign Application Priority Data

Jun. 26, 1986 [CA] Canada ..... 512815

[51] Int. Cl.[4] ..... F42C 19/08

[52] U.S. Cl. ..... 102/204; 102/202.13; 102/272; 102/499

[58] Field of Search ..... 102/204, 202.13, 269, 102/272, 275.3, 487, 488, 499, 500

[56] References Cited

U.S. PATENT DOCUMENTS

| | | | |
|---|---|---|---|
| 844,225 | 2/1907 | Wratzke | 102/499 |
| 3,999,484 | 12/1976 | Evans | 102/202.13 |
| 4,331,078 | 5/1982 | Habbel et al. | 102/275.3 |
| 4,574,702 | 3/1986 | Brandt | 102/272 |

*Primary Examiner*—Charles T. Jordan
*Attorney, Agent, or Firm*—Larson and Taylor

[57] ABSTRACT

An acceleration resistant pyrotechnic delay unit delays the ignition of a warhead subjected to high acceleration on launch and high deceleration on impact. The delay unit includes a delay cup housing a pyrotechnic train. The delay cup has a primer cavity a delay cavity and a detonator cavity. A frusto-conical passage extends between the primer cavity and the delay cavity, with the small diameter end opening into the delay cavity. Primer, delay and detonator components of the pyrotechnic train fill the respective cavities in the delay cup. The various components of the train are well supported on all surfaces to prevent fracture due to high acceleration and deceleration.

7 Claims, 1 Drawing Sheet

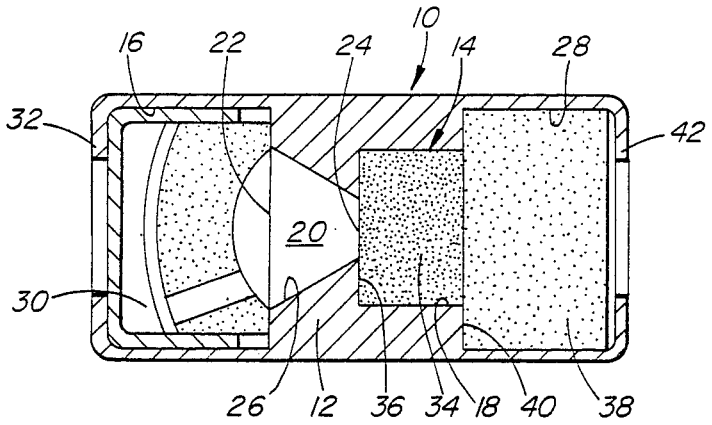
10
16
22
24
14
28
32
42
20
30
26
12
36
34
18
40
38

PYROTECHNIC DELAY FOR HIGH G'S APPLICATION

FIELD OF THE INVENTION

The present invention relates to pyrotechic delay units and more particularly to such units having a high resistance to acceleration.

BACKGROUND

In certain munitions applications, for example with warheads intended to penetrate thick walls such as bunkers or shelters, an impact delay fuze can be employed. This is a fuze which, on impact with the target, will initiate a delay element which will, in turn, allow the warhead to penetrate the wall before initiating the high explosive contents of the warhead. To operate properly the delay column must burn uniformly as the warhead decelerates through the thick target wall and then initiate the explosive train of the warhead.

The problems of designing a pyrotechnic delay that is capable of withstanding the high deceleration encountered on impact of a penetrating warhead are amplified where the delay unit must resist high acceleration on launch, as would be encountered where the warhead was fired from a gun. Additionally, the delay unit should be sized to fit inside the rotor of a safety and arming mechanism. Thus, the three main difficulties to be overcome in designing such a unit are:

1. the delay unit must be sized to fit inside the rotor of a safety and arming mechanism;
2. the delay unit must sustain gun acceleration and be intact at impact on the target; and
3. the delay unit must burn uniformly when the warhead decelerates through hard targets.

SUMMARY

The present invention aims at the provision of a delay unit that will meet these objectives.

According to the present invention there is provided an acceleration resistant pyrotechnic delay unit in the form of a delay cup housing a pyrotechnic train, wherein: the delay cup comprises:

a primer cavity;

a delay cavity;

a passage extending from the primer cavity to an upstream end of the delay cavity, the passage having a downstream end opening into the delay cavity that is substantially smaller in area than the upstream end of the delay cavity; and a detonator cavity adjoining the delay cavity at the downstream end thereof, the pyrotechnic train comprising:

a primer in the primer cavity;

a delay column filling the delay cavity; and a pellet of detonator composition filling the detonator cavity.

With a delay unit of this configuration, the various components of the pyrotechnic train are well supported on all of their surfaces. When the delay unit is accelerated, the top of the delay column is well supported by the upstream end of the delay cavity. The large support surface at this end of the cavity also protects the column from a fracture when the shock wave generated on impact reflects from the top end of the delay column. Similar support is provided for the detonator composition.

BRIEF DESCRIPTION OF THE DRAWING

The accompanying drawing illustrates one embodiment of the present invention in longitudinal cross-section.

DETAILED DESCRIPTION

In the accompanying drawing, a delay unit 10 is illustrated as including a delay cup 12 housing a pyrotechnic train 14. The delay cup includes a cylindrical primer cavity 16 at its upstream end, a smaller diameter cylindrical delay cavity 18 spaced downstream and coaxial with the primer cavity, and a frustoconical passage 20 leading from an upstream large diameter end 22 opening into the primer cavity 16 to a small diameter end 24 opening into the delay cavity 18. The passage is defined by a frustoconical wall 26 in the body of the delay cup 12. Immediately downstream from the delay cavity 18 is a larger diameter cylindrical detonator cavity 28.

Housed within the primer cavity 16 of the delay cup is primer cap 30 of conventional form. This cap is designed to ignite on impact of a firing pin with the center of its upstream end. The primer cap 30 is held in place by an annular flange 32 of the delay cup.

A pressed pyrotechnic composition 34 fills the delay cavity 18 and serves as the delay column. This delay column is supported at its upstream end by the relatively large shoulder 36 forming the upstream end of the delay cavity 18 and circumscribing the downstream end 24 of the passage 20. The pressing of the pyrotechnic material 34 inside the cavity 18 ensures that the delay column will grip along the wall of the cavity 18, thus improving the structural strength of the column. The downstream end of the delay column 34 is supported by a detonator composition 38 in the form of a pellet of energetic material filling the detonator cavity 28. This material is also pressed into position to ensure that it grips the walls of the detonator cavity 28. It is well supported at the downstream end of the unit by an annular flange 42.

In operation, the frustoconical passage 20 located under the primer cap 30 directs and concentrates the flame output of the primer onto the top of the delay column 34 to ensure regularity in the initiation of the delay column. The relatively small diameter of the downstream end 24 of the passage 20 as compared with the upstream end of the delay cavity 18 provides a large shoulder 36 providing good support for the column. When the delay unit is accelerated, the top of the column is supported by this shoulder to prevent breaking of the delay column. On impact with the target, a shock wave is generated and travels along the delay column. The shoulder 36 protects the column from fracture when the shock wave is reflected at the upstream end of the column. Similar support is provided for the detonator composition 38.

What is claimed is:

1. An acceleration resistant pyrotechnic delay unit in the form of a delay cup housing a pyrotechnic train, wherein the delay cup comprises:

a primer cavity;

a delay cavity;

a passage extending from the primer cavity to an upstream end of the delay cavity, the passage having a downstream end opening into the delay cavity that is substantially smaller in area than the upstream end of the delay cavity, thus forming a shoulder at the upstream end of the delay cavity circumscribing the said passage downstream end opening; and a detonator cavity adjoining the delay cavity at the downstream end thereof, the pyrotechnic train comprising:

a primer in the primer cavity;

a delay column filling the delay cavity, the material of the delay column being packed up against said shoulder to assure support of said material during acceleration and deceleration; and a pellet of detonator composition filling the detonator cavity.

2. A delay unit according to claim 1, wherein the passage extending from the primer cavity to the delay cavity is frusto-conical, with its smaller end opening into the delay cavity.

3. A delay unit according to claim 1, wherein the delay column is pressed into the delay cavity.

4. A delay unit according to claim 3, wherein the detonator composition is press fit into the detonator cavity.

5. A delay unit according to claim 1, wherein the delay cavity is cylindrical.

6. A delay unit according to claim 5, wherein the detonator cavity is cylindrical.

7. A delay unit according to claim 6, wherein the primer cavity, the delay cavity, the detonator cavity and the passage extending from the primer cavity to the delay cavity are co-axial.

* * * * *